US009224571B2

(12) United States Patent
Urakawa et al.

(10) Patent No.: US 9,224,571 B2
(45) Date of Patent: Dec. 29, 2015

(54) PHOTOCATHODE HIGH-FREQUENCY ELECTRON-GUN CAVITY APPARATUS

(75) Inventors: Junji Urakawa, Tsukuba (JP); Nobuhiro Terunuma, Tsukuba (JP); Toshikazu Takatomi, Tsukuba (JP)

(73) Assignees: INTER-UNIVERSITY RESEARCH INSTITUTE CORPORATION, Tsukuba-Shi (JP); HIGH ENERGY ACCELERATOR RESEARCH ORGANIZATION, Tsukuba-Shi (JP)

( * ) Notice: Subject to any disclaimer, the term of this patent is extended or adjusted under 35 U.S.C. 154(b) by 214 days.

(21) Appl. No.: 13/825,918

(22) PCT Filed: Sep. 26, 2011

(86) PCT No.: PCT/JP2011/071887

§ 371 (c)(1), (2), (4) Date: Mar. 25, 2013

(87) PCT Pub. No.: WO2012/043475

PCT Pub. Date: Apr. 5, 2012

(65) Prior Publication Data

US 2013/0187541 A1 Jul. 25, 2013

(30) Foreign Application Priority Data

Sep. 27, 2010 (JP) ..... 2010-215840

(51) Int. Cl.
*H01J 23/20* (2006.01)
*H01J 29/48* (2006.01)
(Continued)

(52) U.S. Cl.
CPC ..... *H01J 29/481* (2013.01); *H01J 3/021* (2013.01); *H01J 3/36* (2013.01); *H05H 7/08* (2013.01);
(Continued)

(58) Field of Classification Search
CPC ..... H01J 29/481
USPC ..... 315/5.53
See application file for complete search history.

(56) References Cited

U.S. PATENT DOCUMENTS 7,345,435 B1 * 3/2008 Sekutowicz et al. ..... 315/500

FOREIGN PATENT DOCUMENTS

CN 101888737 A * 11/2010
JP 03-043999 2/1991
(Continued)

OTHER PUBLICATIONS

R. Bosssart, H. Braum, M. Dehler, J-C. Godot; A 3 GHz Photoelectron Gun for High Beam Intensity; European Organization for Nuclear Research.
(Continued)

*Primary Examiner* — Sibin Chen
*Assistant Examiner* — Metasebia Retebo
(74) *Attorney, Agent, or Firm* — Manabu Kanesaka

(57) ABSTRACT

A photocathode high-frequency electron-gun cavity apparatus of the present invention is provided with a high-frequency acceleration cavity (1), a photocathode (8, 15), a laser entering port (9), a high-frequency power input coupler port (10), and a high-frequency resonant tuner (16). Here, the apparatus adopts an ultra-small high-frequency accelerator cavity which contains a cavity cell formed only with a smooth and curved surface at an inner face thereof without having a sharp angle part for preventing discharging, obtaining higher strength of high-frequency electric field, and improving high-frequency resonance stability. Further, the photocathode is arranged at an end part of a half cell (5) of the high-frequency acceleration cavity for maximizing electric field strength at the photocathode face, perpendicular incidence of laser is ensured by arranging a laser entering port at a position facing to the photocathode behind an electron beam extraction port of the high-frequency acceleration cavity for maximizing quality of short-bunch photoelectrons, and a high-frequency power input coupler port is arranged at a side part of the cell of the high-frequency acceleration cavity for enhancing high-frequency electric field strength. According to the above, it is possible to provide a small photocathode high-frequency electron-gun cavity apparatus capable of generating a high-strength and high-quality electron beam.

3 Claims, 8 Drawing Sheets

(51) Int. Cl.

| | |
|---|---|
| ***H05H 7/08*** | (2006.01) |
| ***H01J 3/02*** | (2006.01) |
| ***H01J 3/36*** | (2006.01) |
| *H05G 2/00* | (2006.01) |

(52) U.S. Cl.

CPC ..... *H01J 2237/0432* (2013.01); *H01J 2237/04735* (2013.01); *H01J 2237/062* (2013.01); *H01J 2237/06333* (2013.01); *H05G 2/00* (2013.01); *H05H 2007/084* (2013.01)

(56) References Cited

FOREIGN PATENT DOCUMENTS

| | | |
|---|---|---|
| JP | 05-029097 | 2/1993 |
| JP | 06-176723 | 6/1994 |
| JP | 07-065707 | 3/1995 |
| JP | 07-073998 | 3/1995 |
| JP | 07-226300 | 8/1995 |
| JP | 07-296998 | 11/1995 |
| JP | 2001-343497 | 12/2001 |
| JP | 2002-313218 | 10/2002 |
| JP | 2005-050646 | 2/2005 |
| JP | 2008-117667 | 5/2008 |
| JP | 2008-243671 | 10/2008 |

OTHER PUBLICATIONS

X. Qiu, K. Batchelor, I. Ben-Zvi, X-J. Wang; Demonstration of Emmittance Compensation through the measurement of the slice emittance; 1996 the American Physical Society.

N. Terunuma et al; Improvement of an S-band RF gun with a Cs2Te Photocathode for the'KEK-AFT; Nuclear Instruments and Methods in Physics Research.

X. J. Wang et al; Experimental observation of high-brightness microbunching in a photocathode rf electron gun; The American Society.

B.E. Carlsten; New photoelectric injector design for the los alamos national laboratory xuv fel accelerator; Nuclear Instruments and Method in Physics Research.

Koichiro Hirano et al; High-Intensity Multi-Bunch Beam Generation by a Photo-Cathode Rf Gun; Nuclear Instruments and Methods in Physics Research.

* cited by examiner

PHOTOCATHODE HIGH-FREQUENCY ELECTRON-GUN CAVITY APPARATUS

RELATED APPLICATIONS

The present application is National Phase of International Application No. PCT/JP2011/071887 filed Sep. 26, 2011, and claims priority from Japanese Application No. 2010-215840, filed Sep. 27, 2010.

TECHNICAL FIELD

The present invention relates to a photocathode high-frequency electron-gun cavity apparatus in which electrons generated by entering laser light to a photocathode are accelerated in a high-frequency electric field being a resonant state formed in a high-frequency acceleration cavity having high-frequency power be introduced and from which the electrons are emitted as a high-speed electron beam. More specifically, the present invention relates to an ultra-small photocathode high-frequency electron-gun cavity apparatus which enables to downsize a variety of accelerators for generating a high-luminance electron beam, an electron gun, an X-ray generating apparatus with laser inverse Compton scattering, and the like.

BACKGROUND ART

Not only as an electron gun, an electron source apparatus to generate and emit an electron beam is widely used as an electron beam supplying source to enter an electron beam to a variety of apparatuses such as an accelerator (an electron synchrotron, a linear accelerator, and the like). Further, recently, development of a small X-ray source using laser inverse Compton scattering is proceeding as an X-ray source of an X-ray apparatus such as an X-ray bioimaging apparatus and an X-ray absorption imaging apparatus. An X-ray source using laser inverse Compton scattering generates a photon beam (an X-ray) having predetermined energy by causing laser light to collide with an accelerated electron beam (inverse Compton scattering). Currently, a small electron source apparatus capable of generating a high-strength and high-quality electron beam for actualizing a small X-ray source and the like described above.

Conventionally, in development of an electron source apparatus, work and the like have been conducted with generation and acceleration of a multi-bunch electron beam using a thermoelectron gun (an electron generation method using a hot-cathode). Under a situation that quality of an electron beam is not sufficiently improved with the thermoelectron gun method, recently, an epochal electron acceleration method and an acceleration cavity being a so-called Brookhaven National laboratory (BNL) type high-frequency acceleration cavity to effectively accelerate electrons in a short distance have been devised. With this method, electron acceleration is performed with a high-frequency electric field. Here, since electric field strength having about 10 or more times higher than electric field strength due to a conventional direct-current electric field can be obtained, downsizing of an electron gun has been expected.

As illustrated in FIG. 8, the BNL type high-frequency acceleration cavity has a basic structure in which a half cell (0.5 cell) 5 and a full cell (1.0 cell) 6 are connected. The length of the half cell 5 on the electron beam axis direction (right-left direction in the drawing) is set to be 0.6 times of the length of the full cell 6 in the axis direction for suppressing beam diffusion. High-frequency power transmitted within a waveguide is supplied into the full cell 6 firstly through a high-frequency power input coupler port 10 (a coupling hole) arranged at a wall face of the full cell 6, and then, supplied to the half cell 5 through an aperture portion (iris) between both the cells. The half cell 5 includes a laser entering port 9 for entering laser light and a detachable end plate 2B. A photocathode 7 made of metal such as Cu and Mg is arranged at the center of the end plate 2B. The end plate 2B is attached to a half cell body via a vacuum seal (helicon-flex seal) 2S and is removed from a half cell body when replacing the photocathode 7 for maintenance or research on cathode material. Adjustment of a resonance frequency of the half cell 5 is performed by increasing and decreasing a cell volume with adjustment of fastening torque of the helico-flex seal 2S. Meanwhile, adjustment of a resonance frequency of the full cell 6 is performed by adjusting positions of adjusting rods (two in total as being symmetrically arranged) capable of being moved up and down respectively within a tuner hole having a diameter of 10 mm formed at a cavity wall of the full cell 6.

CITED LITERATURE

Patent Literature

Patent Literature 1: Japanese Patent Application Laid-Open No. 06-176723

Patent Literature 2: Japanese Patent No. 3119285

Patent Literature 3: Japanese Patent Application Laid-Open No. 07-226300

Patent Literature 4: Japanese Patent Application Laid-Open No. 2002-313218

Patent Literature 5: Japanese Patent Application Laid-Open No. 05-029097

Patent Literature 6: Japanese Patent Application Laid-Open No. 07-296998

Patent Literature 7: Japanese Patent Application Laid-Open No. 2008-117667

Non-Patent Literature

Non-Patent Literature 1: Carlsten, B. E., Nuclear Instruments and Methods in Physics Research A, volume 285, Issue 1-2, 1989, Pages 313-319.

Non-Patent Literature 2: Wang, X. J., Qiu, X., Ben-Zvi, I., Physical Review E—Statistical Physics, Plasmas, Fluid, and Related Interdisciplinary Topics, Volume 54, Issue 4, SUPPL. A, 1996, Pages R3121-R3124.

Non-Patent Literature 3: Qiu, X., Batchelor, K., Ben-Zvi, I., Wang, X.-J, Physical Review Letters, Volume 76, Issue 20, 1996, Pages 3723-3726.

Non-Patent Literature 4: Bossart, R., Braun, H., Dehler, M., Godot, J.-C., Nuclear Instruments and Methods in Physics Research, Section A: Accelerators, Spectrometers, Detectors and Associated Equipment, Volume 375, Issue 1-3, 1996, Pages ABS7-ABS8.

Non-Patent Literature 5: K. Hirano, M. Fukuda, M. Takano, Y. Yamazaki, T. Muto, S. Araki, N. Terunuma, M. Kuriki, M. Akemoto, H. Hayano, J. Urakawa, Nuclear Instruments and Methods in Physics Research A, Volume 560, 2006, Pages 233-239.

Non-Patent Literature 6: N. Terunuma, A. Murata, M. Fukuda, K. Hirano, Y. Kamiya, T. Kii, M. Kuriki, R. Kuroda, H. Ohgaki, K. Sakaue, M. Takano, T. Takatomi, J. Urakawa, M. Washio, Y. Yamazaki, J. Yang, Nuclear Instruments and Methods in Physics Research A, Volume 613, 2010, Pages 1-8.

SUMMARY OF THE INVENTION

Problems to be Solved by the Invention

In the BNL type high-frequency acceleration cavity, maximization of electric field at a cathode face 8 is achieved by arranging the cathode 7 at an end part of the half cell side as an electron source. Further, a high-frequency resonant state is generated by arranging a high-frequency power input coupler port at the full cell side for input of high-frequency power. For example, the above is reported in Non-patent Literatures 1 to 4. However, there has been a problem with a conventional BNL type high-frequency acceleration cavity that a high-frequency resonant state is difficult to be stably maintained owing to a structure which is not preferable for high-frequency resonance, that is, a structure to disturb smoothness/shape of a cavity inner face and resonance, for example, a seal structure (helicon flex seal 2S) at an end part of a high-frequency acceleration cavity 31 or the like.

In general, a shape of a cavity cell structuring a high-frequency acceleration cavity is designed so that a frequency of a specific high-frequency power input wave to be used is matched with a cavity resonance frequency which is determined by the cavity shape. Here, cavity resonance performance can be indicated by a Q-factor (indicator of high-frequency resonance stability). Conventionally, acquiring a cavity resonance frequency from a cavity shape has been performed. However, little has been done to derive an appropriate cavity shape from a frequency of high-frequency power. For example, a conventional BNL type high-frequency acceleration cavity adopts a dumbbell-shaped cavity cell being a commonly-called disk-loaded standing wave type. Here, little is known for designing of a cavity cell in which an inner face has a curved surface shape regarding a high-frequency acceleration cavity for an electron gun.

Normally, a high-frequency acceleration cavity is manufactured by cutting an oxygen-free copper material and polishing at a cavity inner face is performed with mechanical polishing using an abrasive agent such as diamond abrasive grains. Since there is a limitation to an abrasive grain size of an abrasive agent, it is difficult to obtain atomic-level smoothness. Accordingly, there has been a problem that discharging of high-frequency power in a cavity is difficult to be suppressed. If discharge occurs in a cavity, the upper limit of high-frequency power to be applied to a cathode must be set low. Acceleration of a generated electron beam due to high-frequency power is decreased accordingly. The above may be a factor to increase emittance (an indicator quantitatively indicating a diffusion degree of an electron beam in a sectional direction).

Conventionally, there has been adopted an electron generation method using a hot-cathode as an electron generation source as described above. There has been a drawback that the emittance becomes large owing to unevenness of energies of discharged thermoelectrons and quality of a beam becomes inferior. In addition, there has been a problem that dark current occurs substantially. Since it is difficult to generate high-quality electron beam with the hot-cathode method as described above, there has been proposed a method having a photocathode as an electron generation source. With the photocathode method, although the problem of dark current generation remains, discharge directions and energies of discharged electron beams are uniformed extremely well owing to utilization of the photoelectric effect for the electron generation method. According to the above, an emittance value thereof was expected to be improved by one digit or close to two digits better than that of a hot-cathode. The above is disclosed in Patent Literatures 1 to 4, for example. However, there has been a problem with a conventional photocathode method using a cathode made of metal (Cu, Mg, or the like) that a quantum efficiency is low and that suppressing of occurrence of dark current (which causes the abovementioned discharge and the like) caused by electric field electron discharge is difficult. There has been a problem for a photocathode having a low quantum efficiency that high-strength laser pulses are required for electron beam generation and that an electron source apparatus is limited to a single-bunch beam generation owing to difficulty of generating a multi-bunch beam. Since laser for generating multi-bunch electron beam cannot have sufficiently large power per bunch, a photocathode having a low quantum efficiency is not appropriate to be used therefor.

Deviation between a high-frequency power frequency and a cavity resonance frequency occurs as a result of manufacturing errors of a cavity cell, shape variation of the cavity cell due to temperature increase, occurrence of beam current, and the like. In general, a high-frequency resonant tuner is used for correction of the above. As conventional high-frequency resonant tuners, there have been known a so-called volume-type high-frequency resonant tuner which is structured to vary volume of a cavity cell and a so-called induction-type high-frequency resonant tuner which is structured to vary inductance of a cavity cell. Each of the above is used by inserting a tuner top end to a small penetration hole arranged at a cavity cell of a high-frequency acceleration cavity. The method thereof is disclosed in Patent Literatures 5 and 6. However, there has been a problem, with a conventional high-frequency resonant tuner, of resonance frequency detuning due to discharging at spaces at a hole section of a cavity cell seizing with sliding of the tuner.

Previously, the inventors found out that dark current could be suppressed by using a photocathode plug having a conductive RF contactor at a contact portion with a high-frequency acceleration cavity as a photocathode and is disclosed in Non-patent Literatures 5 and 6. Further, it was also found out that an excellent high-frequency resonant state could be obtained by using a non-insertion type high-frequency resonant tuner for mechanically adjusting a resonance frequency of a cavity cell from the outside without being inserted into the cavity cell. This method is disclosed, for example, in Patent Literature 7 as well as Non-patent Literatures 5 and 6.

The inventors have been performing tests using an apparatus in which the photocathode plug having the conductive RF contactor and the non-insertion type high-frequency resonant tuner are arranged at a conventional BNL type high-frequency acceleration cavity. However, it has been difficult to stably generate a high-strength and high-quality electron beam on the order of ten kilo watts.

In view of the above, an object of the present invention is to provide a small photocathode high-frequency electron-gun cavity apparatus which enables to downsize a variety of accelerators for generating a high-luminance electron beam, an electron gun, an X-ray generating apparatus with laser inverse Compton scattering, and the like and which is capable of generating a high-strength and high-quality electron beam. More specifically, an object thereof is to provide an ultra-small photocathode high-frequency electron-gun cavity apparatus capable of generating a high-strength and high-quality electron beam on the order of kilo watts.

Means for Solving the Problem

With repeated studies to achieve the above objects, the inventors found out a fact that a new type photocathode high-frequency electron-gun cavity apparatus including a high-frequency acceleration cavity which contains a cavity cell with an inner face having a smooth and curved surface shape approaching to a standing wave waveform particularly suitable for acceleration high-frequency high-electric field as a high-frequency acceleration cavity and to which a photocathode, a laser entering port, a high-frequency power input coupler port, a vacuum exhaust port, and a high-frequency resonant tuner are arranged is extremely effective. Then, the present invention was completed based on the above finding.

The present invention provides a photocathode high-frequency electron-gun cavity apparatus structured with a BNL type high-frequency acceleration cavity, including a high-frequency acceleration cavity formed by connecting a plurality of cavity cells, each having a curved surface shape formed with any of a trigonometric-function curved line, an arc, an oval, and a parabola so that an inner face of the cavity cell is formed to have a smooth and curved surface shape approaching to a standing wave waveform suitable for an acceleration high-frequency high-electric field, a photocathode which is arranged at an end part of the cavity cell of the high-frequency acceleration cavity, a laser entering port which is arranged at a position facing to the photocathode behind an electron beam extraction port of the high-frequency acceleration cavity and which is used for entering of laser light supplied to the photocathode into the high-frequency acceleration cavity, a high-frequency power input coupler port which is arranged at a side part of the high-frequency acceleration cavity and which is used for inputting high-frequency power into the high-frequency acceleration cavity, a vacuum exhaust port which is arranged at a side part of the high-frequency acceleration cavity and which is used for vacuum exhausting of the high-frequency acceleration cavity, and a high-frequency resonant tuner which is arranged at a side part of the high-frequency acceleration cavity and which is used for adjusting a high-frequency resonance frequency at the cavity cell. Here, the inner face of each cavity cell is formed only with a curved surface shape without having a sharp angle part, each curved surface shape at the vicinity of a top section of each cavity cell and an iris is formed with an arc and a curvature radius R thereof is in a range between 5 and 20 mm inclusive, and surface roughness of the inner face of the cavity cell is 0.05 μm or less.

Further, in the above photocathode high-frequency electron-gun cavity apparatus, it is further preferable that the photocathode plug is a photocathode plug having a conductive RF contactor at a contact section in contact with the high-frequency acceleration cavity and having a $Cs_2Te$ cathode face and that the high-frequency resonant tuner is a non-insertion type high-frequency resonant tuner which is arranged at a side part of the high-frequency acceleration cavity to mechanically adjust the resonance frequency at the cavity cell from the outside without inserting a frequency adjusting rod into the cavity cell.

Further, in the above photocathode high-frequency electron-gun cavity apparatus, it is further preferable that the high-frequency resonant tuner is a non-insertion type high-frequency resonant tuner which is arranged at a side part of the high-frequency acceleration cavity to mechanically adjust the resonance frequency at the cavity cell from the outside without inserting a frequency adjusting rod into the cavity cell the apparatus is capable of generating a multi-bunch electron beam having 3 kilo watts or more to be used as an electron source apparatus of an X-ray generation apparatus with laser inverse Compton scattering.

Effects of the Invention

According to the photocathode high-frequency electron-gun cavity apparatus of the present invention, in an ultra-small electron source apparatus having a length of about one tenth or shorter compared to a conventional apparatus, it is possible to drastically improve high-frequency electric field strength, a Q-factor of a high-frequency resonance cavity, a quantum efficiency of a cathode, and a charge amount of a generated beam and to drastically reduce discharge and dark current in a cavity. According to the above, it is possible to generate a high-strength and high-quality electron beam. Accordingly, the present invention is effective for conventionally-difficult downsizing of an accelerator for generating a high-strength and high-quality electron beam, an electron gun, an X-ray generating apparatus with laser inverse Compton scattering, and the like. For example, the photocathode high-frequency electron-gun cavity apparatus of the present invention having a cavity total length of about 36 cm can provide high-frequency electric field strength being 140 MV/m (about 14 times higher than electric field strength of a conventional direct-current electron gun), a Q-factor of the high-frequency resonance cavity being an indicator of high-frequency resonance stability being 15000 (about two times of a Q-factor of a conventional high-frequency acceleration cavity), dark current being 100 pico amperes or less (one hundredth or less of dark current of a conventional high-frequency electron gun), a quantum efficiency of the photocathode being several percent (about 1000 times higher than a quantum efficiency of a conventional cathode), and a charge amount of a photoelectron beam being 10 micro coulombs per pulse (about 10000 times larger than a charge amount of a conventional photocathode electron source). With the above, it is possible to generate a high-strength electron beam of 12 MeV with average current being 0.5 mA. Thus, the high-strength electron beam generating apparatus having a total length of about 36 cm is a high-quality electron beam generating apparatus on the order of ten kilo watts.

EMBODIMENT OF THE INVENTION

In the following, an embodiment of the present invention will be described in detail with reference to the drawings.

Figure 1:
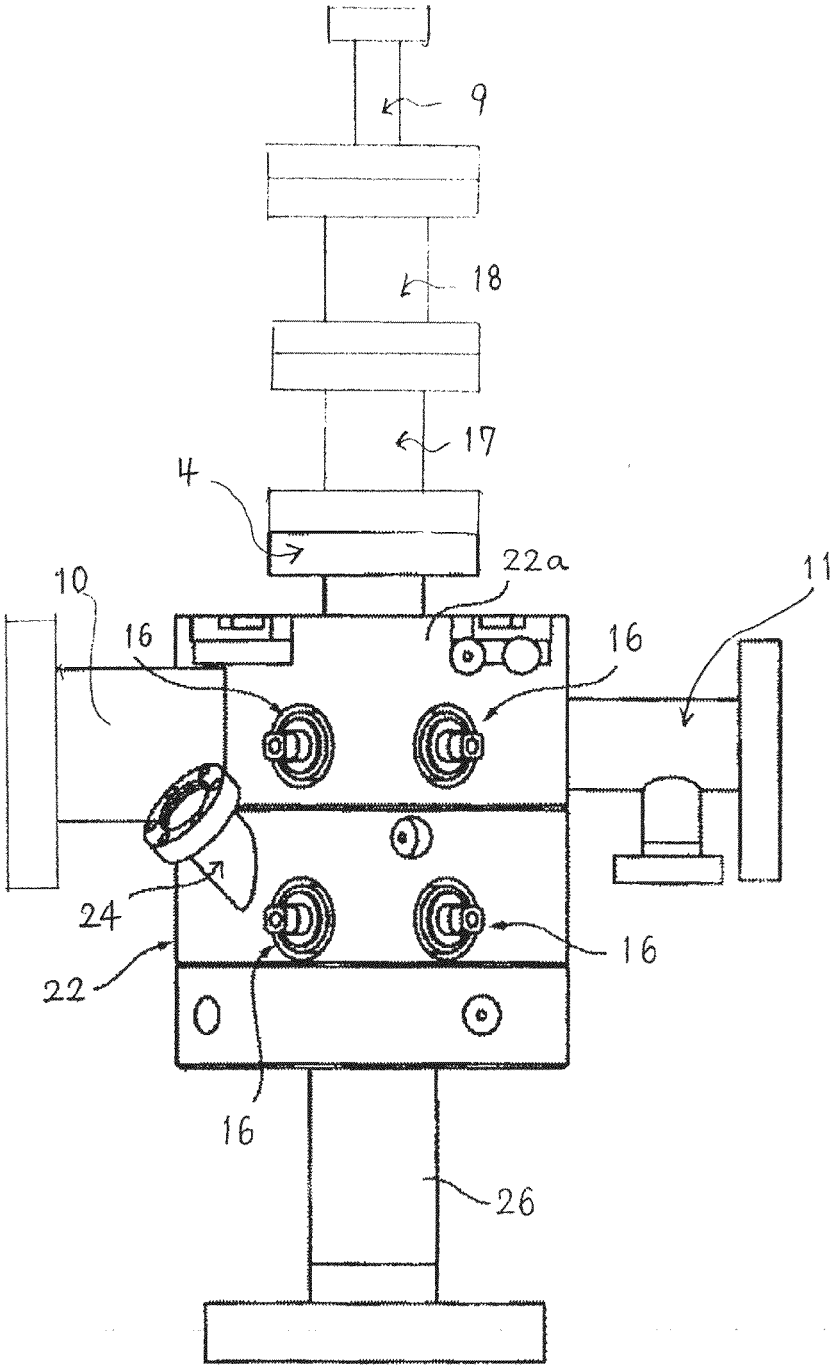
FIG. 1 is a top view illustrating an example of appearance of a photocathode high-frequency electron-gun cavity apparatus of an embodiment of the present invention.
Figure 2:
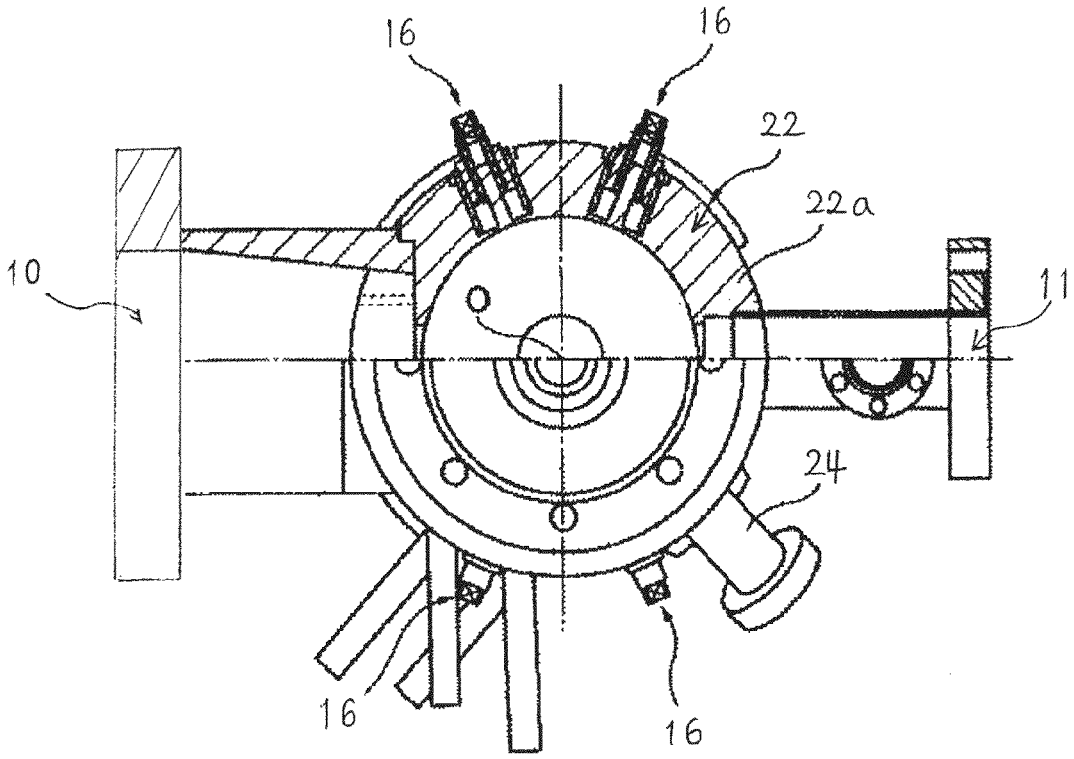
FIG. 2 is a partially-sectioned front view of the photocathode high-frequency electron-gun cavity apparatus of FIG. 1.

FIG. 1 is a top view illustrating an example of appearance of a photocathode high-frequency electron-gun cavity apparatus of an embodiment of the present invention and FIG. 2 is a partially-sectioned front view of the photocathode high-frequency electron-gun cavity apparatus in FIG. 1. As illustrated in the drawings, the photocathode high-frequency electron-gun cavity apparatus of the present embodiment is structured with an approximately-cylindrical housing 22 (circumferential wall portion 22*a*) as a main body. For example, the housing 22 is formed of oxygen-free copper having superior thermal and electric characteristics with a less gas emission amount in vacuum. A high-frequency acceleration cavity 1 in the photocathode high-frequency electron-gun cavity apparatus of the present embodiment is formed by performing machining (internal machining, port-hole machining, or the like) on the housing 22. Here, it is also possible to adopt a manufacturing method, for example, with which a portion for a half-cell section and a portion for a full-cell section are separately prepared and separately machined as the housing 22 and the high-frequency acceleration cavity 1 is formed by connecting the portions thereafter.

Figure 7:
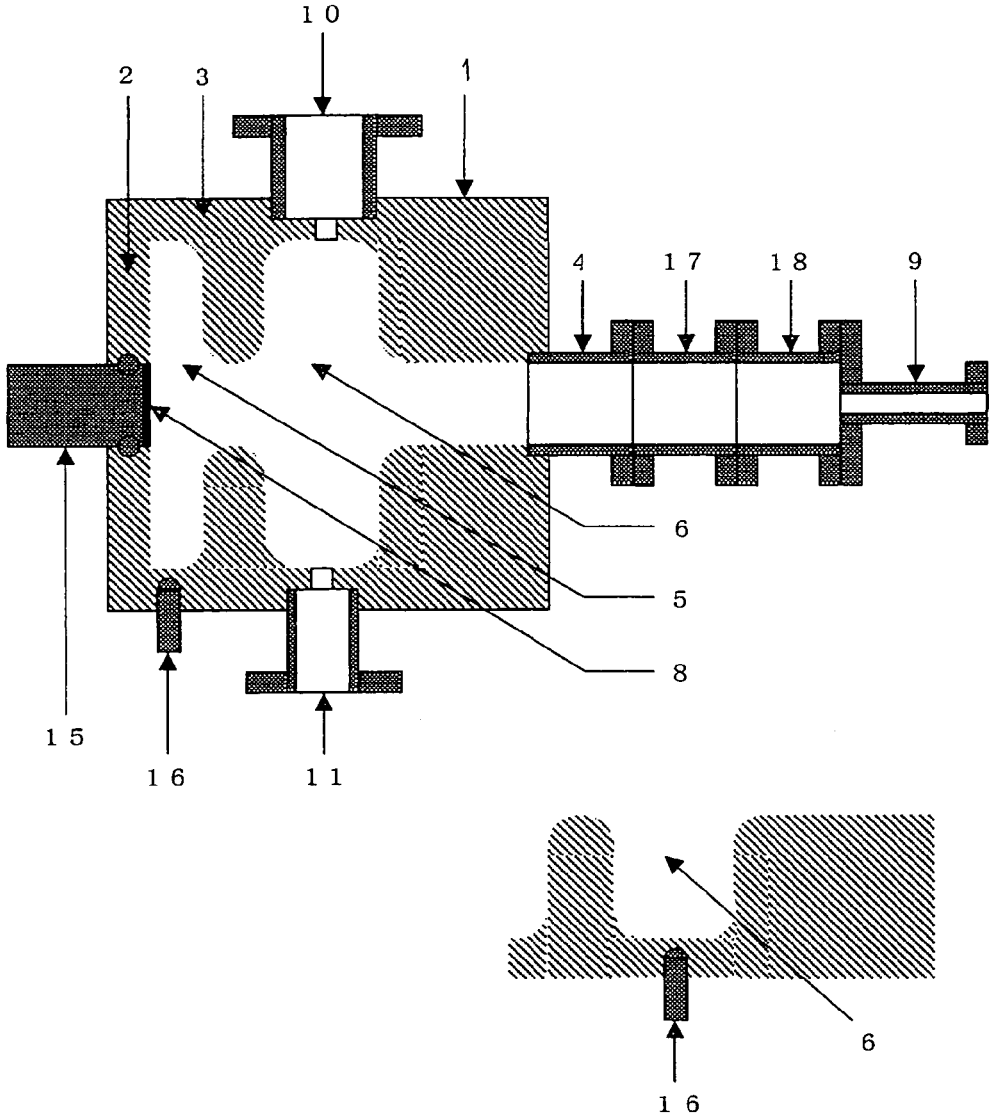
FIG. 7 is a sectional view illustrating a structure of example 5 of the photocathode high-frequency electron-gun cavity apparatus according to the embodiment of the present invention.

As illustrated in FIG. 7 (example 5) which is described later, for example, in the high-frequency acceleration cavity 1, a photocathode (a photocathode plug 15 having an RF contactor in example 5) which emits electrons owing to a photoelectric effect against entering of laser light is arranged at one end thereof. Further, a half cell 5 is formed at the photocathode side in the cavity and a full cell 6 is formed subsequently. The housing 22 (high-frequency acceleration cavity 1) is provided with an electron beam extraction port 4 for extracting an electron beam generated and accelerated in the high-frequency acceleration cavity 1, a high-frequency power input coupler port 10 for inputting high-frequency power into the high-frequency acceleration cavity 1, a vacuum exhaust port 11 for vacuum exhausting of the high-frequency acceleration cavity 1, and a view port 24 for observing the inside of the high-frequency acceleration cavity 1 from the outside. In an example of FIG. 1, four non-insertion type high-frequency resonant tuners 16 in example 5 described later are arranged for each cell (e.g., symmetrically and radially against the center O of the high-frequency acceleration cavity 1 as illustrated in FIG. 2). A guide member 26 is attached to the housing 22. The guide member 26 guides the photocathode plug 15 having the RF contactor in example 5 to the high-frequency acceleration cavity 1 while being kept in a high vacuum state.

High-frequency power having a predetermined frequency transmitted through a waveguide which is attached to the high-frequency power input coupler port 10 is firstly supplied into the full cell 6 of the high-frequency acceleration cavity 1 via the high-frequency power input coupler port 10, and then, is supplied into the half cell 5 passing through an aperture portion (iris) between both the cells. According to the above, a high-frequency resonant state (standing wave) is formed in the cavity. Meanwhile, laser light entering into the high-frequency acceleration cavity 1 via a laser entering port 9 arranged behind the electron beam extraction port 4 is radiated to the photocathode. Electron generated owing to the photoelectric effect at the photocathode are extracted and accelerated at the high frequency in the resonant state. Then, the accelerated electron beam is emitted via the electron beam extraction port 4.

In the following, features of a photocathode high-frequency electron-gun cavity apparatus of the present embodiment will be schematically described and specific examples will be subsequently described.

Many of conventional BNL type high-frequency acceleration cavities are structured respectively with a dumbbell-shaped cavity cell commonly called a disk-loaded standing wave type. A cavity cell having a curved surface shape is hardly known as a high-frequency acceleration cavity for an electron gun. The present inventors have found that a high-frequency acceleration cavity containing a cavity cell with an inner face having a smooth and curved surface shape which approaches to a standing wave waveform suitable for acceleration high-frequency high-electric field provides a remarkable effect for enhancing electric field, generating an excellent resonant state, discharge preventing, and suppressing dark current, and then, have succeeded in preparing a cavity cell having such a curved surface shape, and in particular, a cavity cell for an electron gun.

The abovementioned cavity cell with the inner face having a smooth and curved surface shape which approaches to a standing wave waveform suitable for acceleration high-frequency high-electric field denotes a cavity cell with a curved line of an inner face approaching to a waveform curved line of a high-frequency standing wave. A trigonometric-function curved line, an arc, an oval, and a parabola approaches to the abovementioned waveform curved line. In the cavity cell in the present embodiment, each corner and each edge of a top section (a section having a large cell diameter) and an iris (a section connecting cells to be a passage for an electron beam) have the smooth and curved surface shape respectively. A curvature radius of the curved surface shape is appropriately set based on a frequency of the high-frequency and a cavity size in use.

Smoothing of the inner face of the cavity cell in the photocathode high-frequency electron-gun cavity apparatus of the present invention is important for discharge preventing in the cavity and stable maintaining of high-frequency electric field strength. The effect of smoothing in enhancing electric field, generating an excellent resonant state, discharge preventing, and suppressing dark current is much larger than the effect of the abovementioned curved surface shape. A possibility of discharging in the cavity becomes small with increase of smoothness. Accordingly, higher smoothness at the inner face of the cavity cell is much appreciated unless there are special circumstances. In the present embodiment, the smoothness of the inner face of the cavity cell is evaluated by surface roughness (arithmetic average roughness). The surface roughness (arithmetic average roughness) of the inner face of the cavity cell of the high-frequency acceleration cavity 1 which can be used in the present embodiment is 0.05 μm or smaller preferably, and 0.02 μm or smaller more preferably. The surface roughness is preferably 0.05 μm or smaller to be capable of drastically reducing a discharging possibility. The smoothness in the above range being drastically higher than smoothness of an inner face of a conventional high-frequency acceleration cavity produces a high effect to remarkably improve electric field strength and a Q-factor in the high-frequency acceleration cavity and a high effect to stably maintain a resonant state for electron acceleration. Smoothing of the inner face of the cavity cell in the present embodiment can be actualized, for example, by performing precision cutting and polishing with a single-crystal diamond tool on a primarily-machined cell.

The high-frequency acceleration cavity 1 being a new type containing the cavity cell having the smooth and curved shape as described above is used in the present embodiment. A half cell (0.5 cell) 5 and a full cell (1.0 cell) 6 are adopted as the cavity cells. Normally, it is structured that the full cell 6 is connected behind the half cell 5. The section connecting the cells is commonly called an iris as described above and is to be a passage for an electron beam. Arrangement of the half cell 5 provides maximized electric field strength at a cathode face 8 by arranging a cathode at an end part of the half cell 5. Arrangement of the full cell 6 provides high-frequency power to further accelerate an electron. Accordingly, electron speed can be cumulatively accelerated with increase of the number of full cells 6. The number of the cavity cells in the high-frequency acceleration cavity 1 used in the present embodiment is 1.5 or larger preferably, and 3.5 or larger more preferably. Although a high-strength electron beam can be extracted only with 0.5 cell, it is preferable to be 1.5 cells or more for extracting an electron beam on the order of kilo watts. Further, it is preferable to be 3.5 cells or more for extracting an electron beam on the order of ten kilo watts.

In the present embodiment, a photocathode being a photoelectron emission type is adopted as the cathode. This is because an emittance value of the photoelectron to be emitted of the photocathode is one digit or close to two digits better than that of a thermoelectron of a hot-cathode. A variety of optical semiconductor thin-film materials which are conventionally known may be used as a material of the photocathode in the present embodiment. Here, it is preferable that the material is a compound of cesium-based alkali metal with another, for example, alkali iodide such as CsI and CsI—Ge, alkali antimonide such as $K_2CsSb$ and $Na_2K(Cs)Sb$, or alkali telluride such as $Cs_2Te$ and RbCsTe. The material is alkali telluride more preferably, and $Cs_2Te$ even more preferably. There is a problem that a lifetime of $Cs_2Te$ is influenced by a degree of vacuum and residual gas as requiring to be used in ultrahigh vacuum. However, since there is a feature that a photoelectron is emitted with a relatively high quantum efficiency with an ultraviolet laser having a wavelength of 270 nm or shorter, it is even more preferable. As described above, in the present embodiment, the photocathode is arranged at the end part at the half cell side in the high-frequency acceleration cavity for maximizing high-frequency electric field strength at the cathode face 8. Further, in the present embodiment, it is preferable that the photocathode adopts a detachably-attachable plug-shaped photocathode plug preferably. It is more preferable that the photocathode adopts a photocathode plug having a conductive RF contactor at a contact section between the high-frequency acceleration cavity and the photocathode plug. Usage of the photocathode plug facilitates replacement of a performance-deteriorated photocathode with a fresh photocathode, replacement of a photocathode for research of cathode materials, and the like. In addition, the usage suppresses a problem such as Q-factor drop and discharge occurrence caused by a complicated shape of a conventional apparatus in which a photocathode-equipped end plate is attached to a half cell body via a vacuum seal (helico-flex seal). Further, it is preferable to provide the conductive RF contactor in view of suppressing high-frequency discharge at the photocathode face 8.

In the present embodiment, the laser entering port 9 (see FIG. 1) is arranged behind the electron beam extraction port 4 of the high-frequency acceleration cavity 1 (see FIGS. 3 to 7) at a position facing to the photocathode. Here, a laser incidence angle against the cathode face 8 can be a right angle and a spot of a radiation portion can be relatively minimized. The above is preferable to relatively minimize emittance. Conventionally, the photocathode 7 is arranged at an end part of the half cell 5 of a BNL type high-frequency acceleration cavity and a laser enters obliquely toward the photocathode face 8 from a side part of the half cell 5. Accordingly, it is difficult to relatively minimize emittance of discharge electrons at the cathode face 8. In such a situation, the present inventors found out that emittance could be relatively minimized by entering a laser at an angle being right or close to being right against the photocathode face 8. In the present embodiment, it is possible, as required, to arrange a solenoid 17, a polarized magnet 18 or the like behind the electron beam extraction port 4 at the high-frequency acceleration cavity 1. The solenoid 17 is adopted for suppressing increase of emittance of the passing electron beam. Further, the polarized magnet 18 is adopted for attaching the laser entering port 9 to a position facing to the photocathode.

In the present embodiment, the high-frequency power input coupler port 10 is arranged at a side part of the high-frequency acceleration cavity 1, and preferably, at a side part of the full cell 6. Arranging the high-frequency power input coupler port 10 at the side part of the full cell 6 is preferable to further accelerate electrons emitted from the photocathode in the high-frequency electric field. Here, it is preferable to attach at the (first) full cell 6 which is located next to the half cell 5.

In the present embodiment, the vacuum exhaust port 11 is arranged at a side part of the high-frequency acceleration cavity 1. Preferably, the vacuum exhaust port 11 is arranged at a position facing to the high-frequency power input coupler port 10. The vacuum exhaust port 11 is arranged to exhaust the cavity to be vacuum. Preferably, the vacuum exhaust port 11 is arranged at the position facing to the high-frequency power input coupler port 10 for maintaining uniformity of the acceleration electric field on a rotational symmetry axis.

In the present embodiment, a high-frequency resonant tuner is arranged at a side part of the high-frequency acceleration cavity 1. Preferably, the tuner is arranged at a position being in a vicinity of a top section of a cavity cell at a side part of the cavity cell so as to enable symmetrical adjustment of the cavity cell to be performed. Here, the number of tuners is not specifically limited. For enabling the symmetrical adjustment, it is preferable to arrange two or more for each cell. In the present embodiment, the high-frequency resonant tuner may adopt a conventional tuner 12 to be used as having a tuner top end inserted into a small penetration hole which is arranged at a cavity cell of a high-frequency acceleration cavity. However, it is preferable to adopt a non-insertion type high-frequency resonant tuner 16 with which a resonance frequency of a cavity cell can be mechanically adjusted from the outside without being inserted to the cavity cell. Since the non-insertion type high-frequency resonant tuner 16 is used without being inserted to a cavity cell inner face, continuous smoothness at the cavity cell inner face is not impaired and there is not a problem of resonance frequency detuning due to seizing at a sliding portion and discharging occurring when a conventional tuner is used. Accordingly, an effect to stably maintain a resonant state is obtained. For example, the non-insertion type high-frequency resonant tuner 16 may adopt a tuner disclosed in Patent Literature 7.

As described above, the photocathode high-frequency electron-gun cavity apparatus of the present embodiment includes the high-frequency acceleration cavity, the photocathode, the laser entering port, the high-frequency power input coupler port, the vacuum-exhaust port, and the high-frequency resonant tuner. Here, the high-frequency acceleration cavity adopts the high-frequency acceleration cavity 1 containing a cavity cell with an inner face having a smooth and curved surface shape which approaches to a standing wave waveform suitable particularly for acceleration high-frequency high-electric field. Further, a new photocathode and a new high-frequency resonant tuner are arranged. Thus, it is possible to generate an electron beam having high-strength and high-quality with an ultra-small apparatus which does not conventionally exist.

As described in the following, being capable of generating a high-strength and high-quality electron beam on the order of ten kilo watts using the ultra-small high-frequency acceleration cavity, the photocathode high-frequency electron-gun cavity apparatus of the present embodiment is extremely effective for downsizing of a variety of accelerators for generating a high-luminance electron beam, an electron gun, an X-ray generating apparatus with laser inverse Compton scattering, and the like. In particular, a high-strength and high-quality electron beam on the order of ten kilo watts capable of being generated by the cavity apparatus of the present embodiment having kinetic energy of accelerated electrons in a range of 6 MeV to 12 MeV is effective for developing a new light-using field such as epochal diagnostic treatment, sterilization, electron beam diffraction, and analysis, photoreaction.

EXAMPLES

Figure 8:
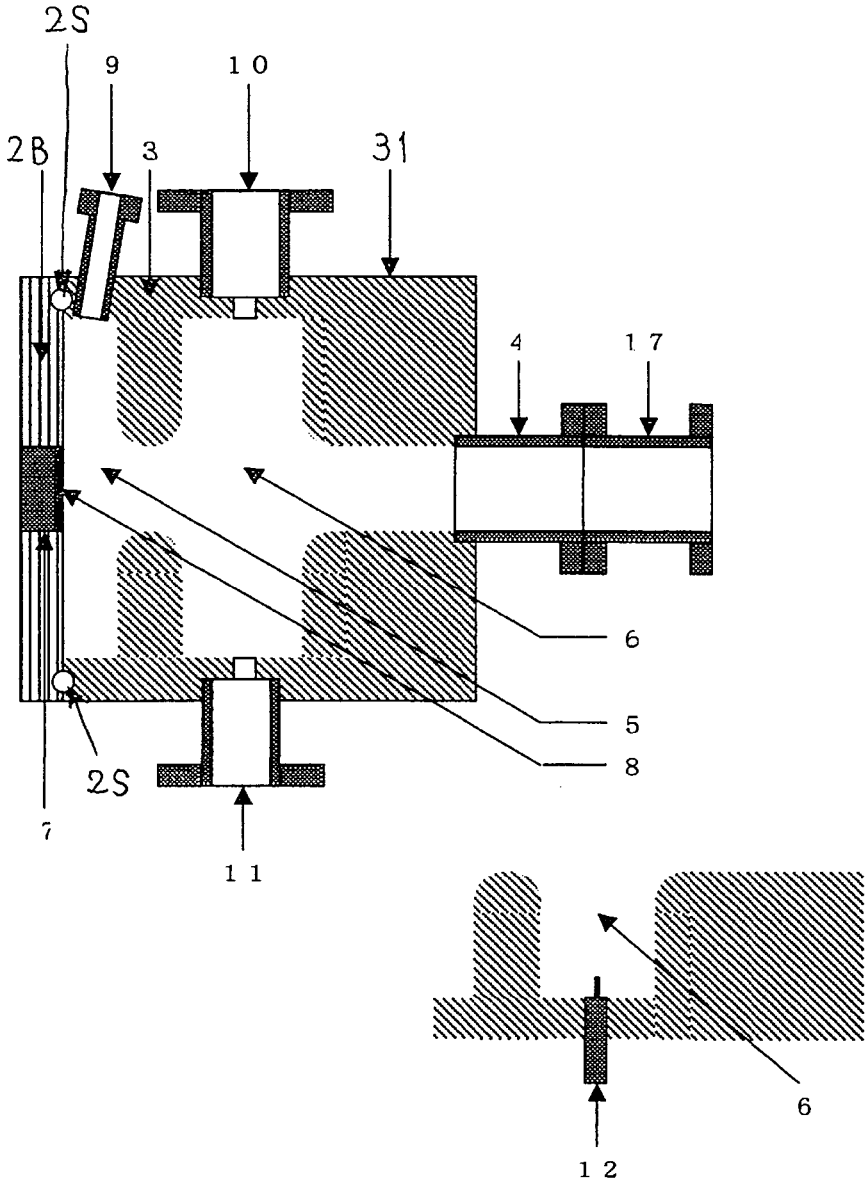
FIG. 8 is a sectional view illustrating a structure of a conventional photocathode high-frequency electron-gun cavity apparatus.

In the following, the photocathode high-frequency electron-gun cavity apparatus of the present embodiment will be specifically described with examples and the like. FIG. 8 is a sectional view illustrating a conventional photocathode high-frequency electron-gun cavity apparatus used as a comparison example. FIGS. 3 to 7 are sectional views illustrating structures of the respective examples (examples 1 to 5) of the photocathode high-frequency electron-gun cavity apparatus of the embodiment of the present invention. Tests of generating electron beams were performed using the respective abovementioned apparatuses while maintaining a degree of vacuum in the cavity at a level of 10-6 Pa, radiating a mode-locking laser with a wavelength of 266 nm to the photocathode, and introducing a high frequency of 2856 MHz. An oblique radiation angle from a laser entering port arranged at an oblique position against the photocathode is set to about 70 degrees against a perpendicular of the photocathode face 8 (comparison example). A radiation angle from the laser entering port arranged at a position facing to the photocathode is set to normal to the photocathode face 8 (examples 1 to 5). High-frequency electric field strength, Q-factors and dark current which indicate performance of a high-frequency acceleration cavity were measured respectively by using a bead perturbation method, a spectrum analyzer, and a current transformer (CT). Quantum efficiencies which indicate photocathode performance were obtained from measurement of generated beam strength and laser pulse strength. Each charge amount per one pulse indicating performance of a generated electron beam was measured by using the CT.

Comparison Example

A BNL type 1.5 cell high-frequency acceleration cavity 31 was prepared based on description of Non-Patent Literature 1 and an apparatus as illustrated in FIG. 8 was prepared by arranging a commercially-available photocathode 7 (a Cu photocathode manufactured by Sumitomo Heavy Industries, Ltd.), a laser entering port 9, a high-frequency power input coupler port 10, a vacuum exhaust port 11, and a commercially-available insertion type high-frequency resonant tuner 12 (T1342 manufactured by Sumitomo Heavy Industries, Ltd.) thereto. A helico-flex seal 2S arranged at an end part of the high-frequency acceleration cavity 31 illustrated in FIG. 8 is used for adjusting resonance of the half cell 5 with adjustment of fastening strength thereof. Two insertion type high-frequency resonant tuners 12 were arranged at a side part of the full cell 6 for adjusting resonance of the full cell 6. An electron beam generation test was performed using the apparatus. As a result, the high-frequency electric field strength in the high-frequency acceleration cavity 31 is about 100 MV/m, the Q-factor is about 7900, the dark current is about 10 nano amperes, the quantum efficiency of the photocathode 7 is about $2\times10^{-3}$%, the charge amount of the generated electron beam is about 1 nano coulomb per pulse, and the average current is about 50 nano amperes (with a single bunch operated at 50 Hz).

Example 1

Effects of a Cavity Cell Having a Smooth and Curved Surface

Figure 3:
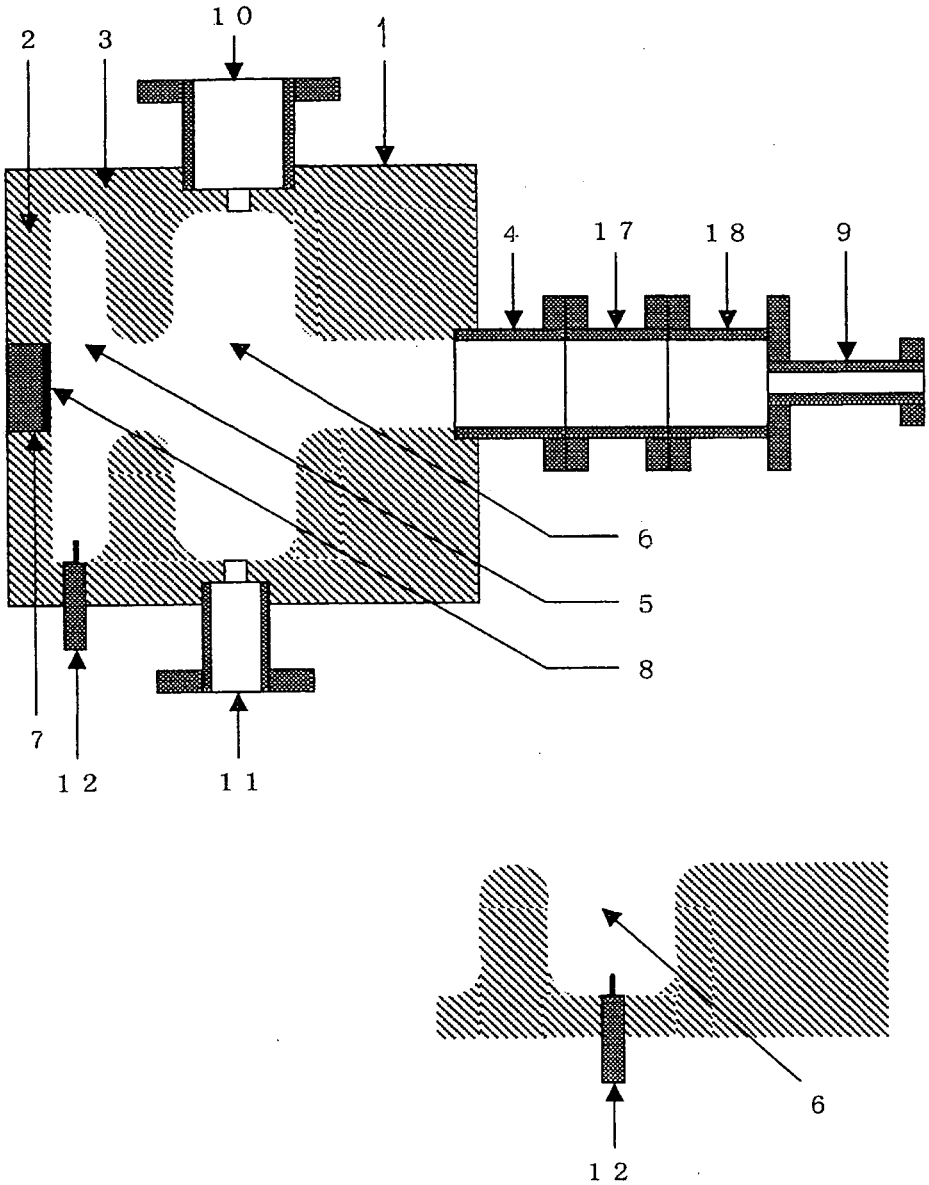
FIG. 3 is a sectional view illustrating a structure of example 1 of the photocathode high-frequency electron-gun cavity apparatus according to the embodiment of the present invention.

A half cell 5 and a full cell 6 each having a curved surface shape which approaches to a standing wave waveform suitable for acceleration high-frequency high-electric field were prepared by roughly preparing a cavity cell with cutting of an oxygen-free copper material and performing precision cutting and precision polishing on the cavity cell inner face using a single-crystal diamond tool. Curved surfaces at a top section and an iris of the prepared cavity cells are arc-shaped curved surfaces. Each radius R thereof is in a range of 5 mm to 20 mm inclusive. As a result of measuring surface roughness (arithmetic average roughness) of the prepared cavity cell inner face, it is confirmed that the surface roughness is 0.05 μm or less. Surface roughness was measured by using surface roughness and profile shape measurement equipment (Mitutoyo form tracer CS-5000 manufactured by Mitutoyo Corporation). Anew type high-frequency acceleration cavity 1 with a total length of about 25 cm having one and half cells was prepared by processing to connect the half cell 5 and the full cell 6. A photocathode high-frequency electron-gun cavity apparatus (example 1) as illustrated in FIG. 3 was prepared by arranging a commercially-available photocathode 7 (a Cu photocathode manufactured by Sumitomo Heavy Industries, Ltd.) at an end part at the half cell side of the high-frequency acceleration cavity 1, arranging a laser entering port 9 at an electron beam extraction port 4 of the high-frequency acceleration cavity 1, arranging a high-frequency power input coupler port 10 at a side part of the full cell 6 of the high-frequency acceleration cavity 1, arranging a vacuum exhaust port 11 at a side part of the high-frequency acceleration cavity 1, and arranging a commercially-available capacitance type high-frequency resonant tuner 12 (T1342 manufactured by Sumitomo Heavy Industries, Ltd.) at each side part of the half cell 5 and the full cell 6 of the high-frequency acceleration cavity 1. The high-frequency resonant tuners 12 were arranged two each at the side parts of the cells. An electron beam generation test was performed using the abovementioned apparatus. As a result, the high-frequency electric field strength in the high-frequency acceleration cavity 1 is about 110 MV/m, the Q-factor is about 8800, the dark current is about 3000 pico amperes, the charge amount of the generated electron beam is about 0.01 micro coulomb per pulse, and the average current is about 0.1 micro ampere. The above result reveals that, compared to the conventional BNL type high-frequency acceleration cavity apparatus, the photocathode high-frequency electron-gun cavity apparatus of example 1 is capable of enhancing the high-frequency electric field strength to be about 1.1 times higher, enhancing the Q-factor to be about 1.1 times higher, reducing the dark current to be about ten thirty-thirds, increasing the charge amount of the generated electron beam to be about 10 times more, and increasing the average current to be about two times more (with 100 bunches/pulse operated at 10 Hz).

Example 2

Effects of a Detachably Replaceable Photocathode Plug

Figure 4:
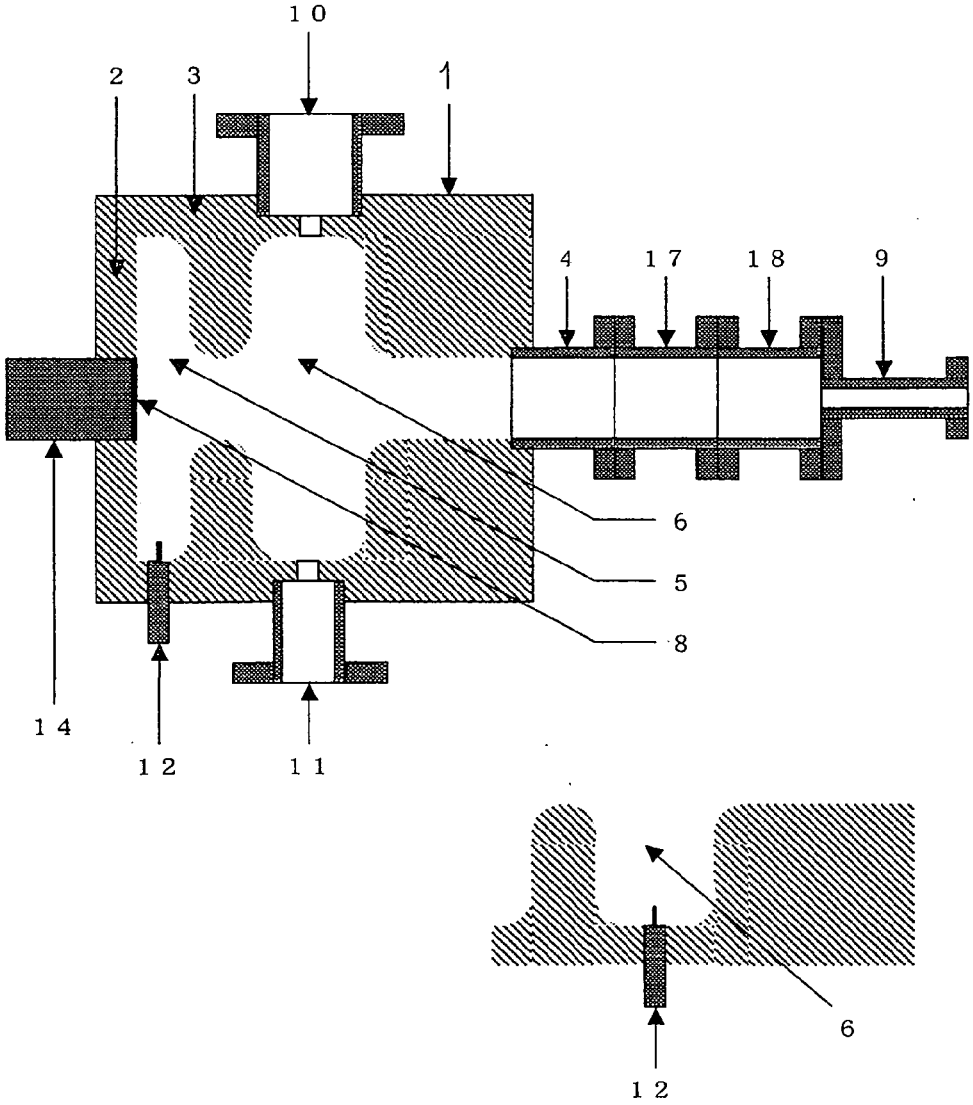
FIG. 4 is a sectional view illustrating a structure of example 2 of the photocathode high-frequency electron-gun cavity apparatus according to the embodiment of the present invention.

An electron beam generation test was performed using a photocathode high-frequency electron-gun cavity apparatus (example 2) illustrated in FIG. 4 with a detachably replaceable photocathode plug 14 arranged instead of the commercially available photocathode 7 in example 1. A $Cs_2Te$-deposited photocathode plug described in Non-patent Literatures 6 and 7 was prepared and used as the detachably replaceable photocathode plug 14. As a result, the high-frequency electric field strength in the high-frequency acceleration cavity 1 is about 120 MV/m, the Q-factor is about 11000, the dark current is about 1000 pico amperes, the quantum efficiency is about 2%, the charge amount of the generated electron beam is about 0.3 micro coulomb per pulse, and the average current is about 3 micro amperes. The above result reveals that, compared to the result of example 1, the photocathode high-frequency electron-gun cavity apparatus of example 2 with the detachably replaceable $Cs_2Te$ photocathode plug 14 is further capable of reducing the dark current to be about one third, increasing the charge amount of the generated electron beam to be about 30 times more, and increasing the average current to be about 30 times more (with 100 bunches/pulse operated at 10 Hz).

Example 3

Figure 5:
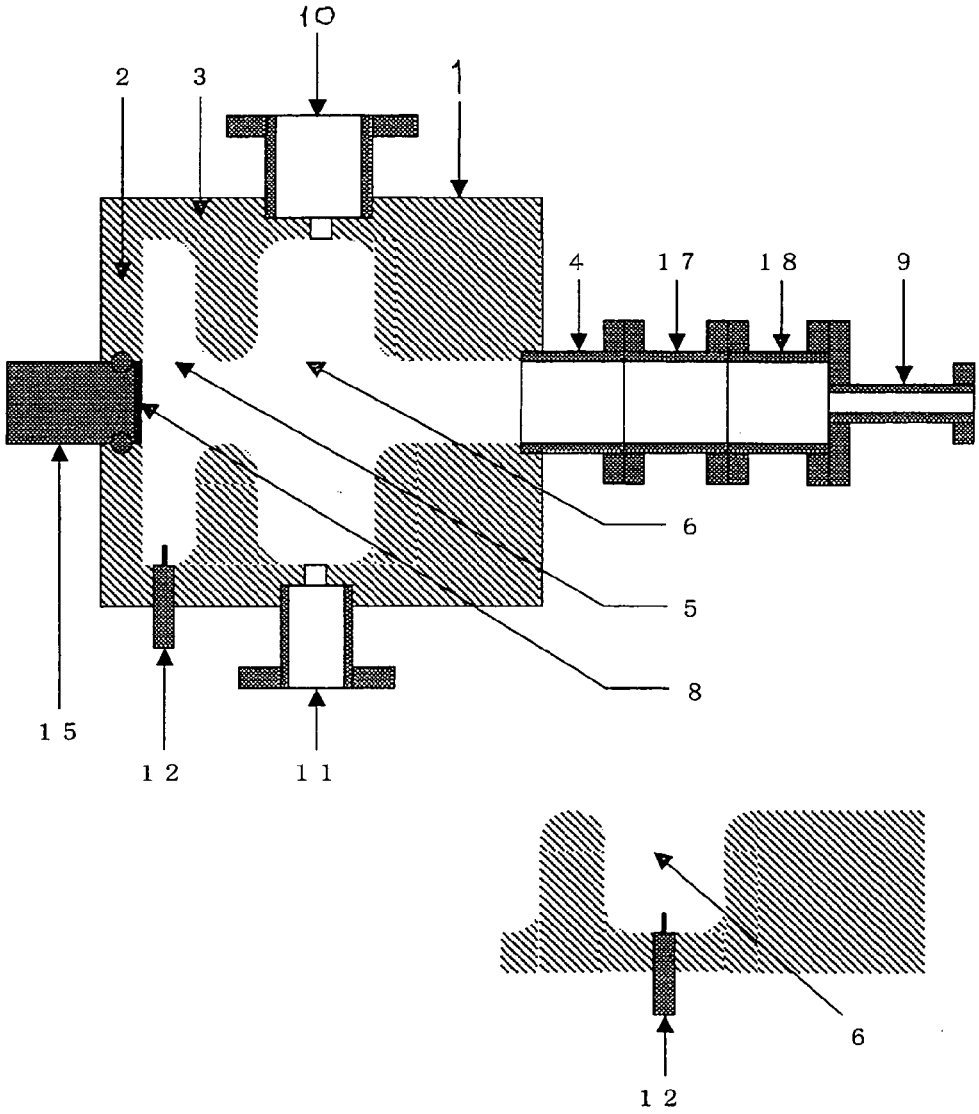
FIG. 5 is a sectional view illustrating a structure of example 3 of the photocathode high-frequency electron-gun cavity apparatus according to the embodiment of the present invention.

Effects of a Detachably Replaceable Photocathode Plug Having a Conductive RF Contactor An electron beam generation test was performed using a photocathode high-frequency electron-gun cavity apparatus (example 3) illustrated in FIG. 5 with a detachably replaceable photocathode plug 15 having a conductive RF contactor arranged instead of the commercially available photocathode 7 in example 1. A $Cs_2Te$-deposited photocathode plug having a conductive RF contactor described in Non-patent Literature 6 is prepared and used as the detachably replaceable photocathode plug 15 having the conductive RF contactor. As a result, the high-frequency electric field strength in the high-frequency acceleration cavity 1 is about 120 MV/m, the Q-factor is about 12000, the dark current is about 100 pico amperes, the quantum efficiency is about 2%, the charge amount of the generated electron beam is about 0.5 micro coulomb per pulse, and the average current is about 5 micro amperes. The above result reveals that, compared to the result of example 1, the photocathode high-frequency electron-gun cavity apparatus of example 3 with the detachably replaceable $Cs_2Te$ photocathode plug 15 having the conductive RF contactor is further capable of reducing the dark current to be about one thirtieth, increasing the charge amount of the generated electron beam to be about 50 times more, and increasing the average current to be about 50 times more (with 50 bunches/pulse operated at 10 Hz).

Effects of a Non-Insertion Type High-Frequency Resonant Tuner

Figure 6:
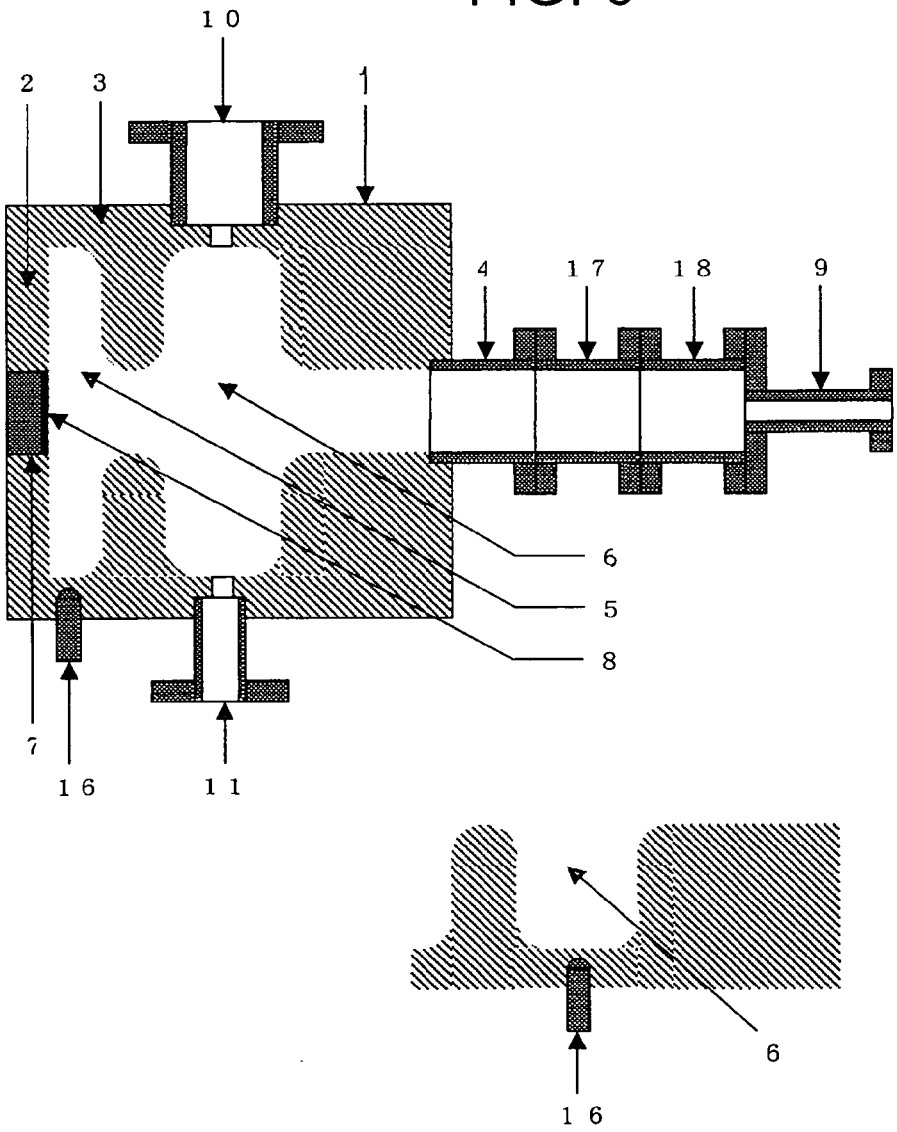
FIG. 6 is a sectional view illustrating a structure of example 4 of the photocathode high-frequency electron-gun cavity apparatus according to the embodiment of the present invention.

An electron beam generation test was performed using a photocathode high-frequency electron-gun cavity apparatus (example 4) illustrated in FIG. 6 with non-insertion type high-frequency resonant tuners 16 arranged instead of the commercially available insertion type high-frequency resonant tuners 12 in example 1. The non-insertion type high-frequency resonant tuners 16 were arranged four each at the side parts of the cells. Non-insertion type high-frequency tuners described in Patent Literature 7 were prepared and used as the non-insertion type resonant tuners 16. As a result, the high-frequency electric field strength in the high-frequency acceleration cavity 1 is about 130 MV/m, the Q-factor is about 13000, the dark current is about 1000 pico amperes, the charge amount of the generated electron beam is about 0.25 micro coulomb per pulse, and the average current is about 2.5 micro amperes. The above result reveals that, compared to the result of example 1, the photocathode high-frequency electron-gun cavity apparatus of example 4 with the non-insertion type high-frequency resonant tuners 16 is capable of enhancing the high-frequency electric field strength to be about 1.2 times higher, enhancing the Q-factor to be about 1.5 times higher, reducing the dark current to be about one thirtieth or less, increasing the charge amount of the generated electron beam to be about 25 times more, and increasing the average current to be about 25 times more (with 500 bunches/pulse operated at 10 Hz).

Example 4

Effects of a Non-Insertion Type High-Frequency Resonant Tuner

An electron beam generation test was performed using a photocathode high-frequency electron-gun cavity apparatus (example 4) illustrated in FIG. 7 with non-insertion type high-frequency resonant tuners 16 arranged instead of the commercially available insertion type high-frequency resonant tuners 12 in example 1. The non-insertion type high-frequency resonant tuners 16 were arranged four each at the side parts of the cells. Non-insertion type high-frequency tuners (see FIGS. 5 and 6) described in Patent Literature 7 were prepared and used as the non-insertion type resonant tuners 16. As a result, the high-frequency electric field strength in the high-frequency acceleration cavity 1 is about 130 MV/m, the Q-factor is about 13000, the dark current is about 1000 pico amperes, the charge amount of the generated electron beam is about 0.25 micro coulomb per pulse, and the average current is about 2.5 micro amperes. The above result reveals that, compared to the result of example 1, the photocathode high-frequency electron-gun cavity apparatus of example 4 with the non-insertion type high-frequency resonant tuners 16 is capable of enhancing the high-frequency electric field strength to be about 1.2 times higher, enhancing the Q-factor to be about 1.5 times higher, reducing the dark current to be about one thirtieth or less, increasing the charge amount of the generated electron beam to be about 25 times more, and increasing the average current to be about 25 times more (with 500 bunches/pulse operated at 10 Hz).

Example 5

Effects Due to Arranging a Detachably Replaceable Photocathode Plug Having a Conductive RF Contactor and a Non-Insertion Type High-Frequency Resonant Tuner at a High-Frequency Acceleration Cavity An electron beam generation test was performed using a photocathode high-frequency electron-gun cavity apparatus (example 5) illustrated in FIG. 7 in which a detachably replaceable deposit photocathode plug 15 having a conductive RF contactor was arranged instead of the commercially available photocathode 7 in example 1 and non-insertion type high-frequency resonant tuners 16 were arranged instead of the commercially available insertion type high-frequency resonant tuners 12 in example 1. The detachably replaceable photocathode plug 15 having the conductive RF contactor is similar to that in example 3 and the non-insertion type high-frequency resonant tuners 16 are similar to those in example 4. The non-insertion type high-frequency tuners 16 were arranged four each as the side parts of the cells. As a result, the high-frequency electric field strength in the high-frequency acceleration cavity 1 is about 140 MV/m, the Q-factor is about 15000, the dark current is about 100 pico amperes, the quantum efficiency of the photocathode is about 2%, the charge amount of the generated electron beam is about 9 micro coulombs per pulse, and the average current is about 90 micro amperes. The above result reveals that, compared to the result of example 1, the photocathode high-frequency electron-gun cavity apparatus of example 5 in which the detachably replaceable $Cs_2Te$ photocathode plug 15 having the conductive RF contactor and the non-insertion type high-frequency resonant tuners 16 are arranged is further capable of enhancing the high-frequency electric field strength to be about 1.3 times higher, enhancing the Q-factor to be about 1.7 times higher, enhancing the quantum efficiency of the photocathode to be about 1000 times higher, reducing the dark current to be about one thirtieth or less, increasing the charge amount of the generated electron beam to be about 900 times more, and increasing the average current to be about 900 times more (with 3000 bunches/pulse operated at 10 Hz).

Main structures and test results of the comparison example and examples 1 to 5 described above are summarized below respectively in tables 1 and 2.

TABLE 1

| | |
|---|---|
| Comparison example | Main structure: BNL type high-frequency acceleration cavity + Commercially available photocathode + Commercially available high-frequency tuner |
| Example 1 | Main structure: High-frequency acceleration cavity of the present embodiment + Commercially available photocathode + Commercially available high-frequency tuner |
| Example 2 | Main structure: High-frequency acceleration cavity of the present embodiment + Photocathode plug + Commercially available high-frequency tuner |
| Example 3 | Main structure: High-frequency acceleration cavity of the present embodiment + Photocathode plug with RF contactor + Commercially available high-frequency tuner |
| Example 4 | Main structure: High-frequency acceleration cavity of the present embodiment + Commercially available photocathode + Non-insertion type tuner |
| Example 5 | Main structure: High-frequency acceleration cavity of the present embodiment + Photocathode plug with RF contactor + Non-insertion, type tuner |

TABLE 2

| | High-frequency electric field strength (MV/m) | Q-factor | Dark current (pico A) | Quantum efficiency (%) | Charge amount (μC/pulse) | Average current (μA) |
|---|---|---|---|---|---|---|
| Comparison example | 100 | 7900 | 10000 | $2 \times 10^{-3}$ | $1 \times 10^{-3}$ | $5 \times 10^{-2}$ |

TABLE 2-continued

| | High-frequency electric field strength (MV/m) | Q-factor | Dark current (pico A) | Quantum efficiency (%) | Charge amount (μC/pulse) | Average current (μA) |
|---|---|---|---|---|---|---|
| Example 1 | 110 | 8800 | 3000 | $2 \times 10^{-3}$ | 0.01 | 0.1 |
| Example 2 | 120 | 11000 | 1000 | 2 | 0.3 | 3 |
| Example 3 | 120 | 12000 | 100 | 2 | 0.5 | 5 |
| Example 4 | 130 | 13000 | 1000 | $2 \times 10^{-3}$ | 0.25 | 2.5 |
| Example 5 | 140 | 15000 | 100 | 2 | 9 | 90 |

The above results reveal that an electron beam having extremely higher strength and quality than those of a conventional apparatus can be generated by using the photocathode high-frequency electron-gun cavity apparatus of the present embodiment. In particular, since the new-type high-frequency acceleration cavity in the photocathode high-frequency electron-gun cavity apparatus of the present embodiment provides a significant effect to suppress dark current and a significant effect to increase a charge amount of an electron beam, downsizing of an electron gun can be actualized with drastic increase of average current. Further, owing to that the new type photocathode plug 14 or the photocathode plug 15 with the RF contactor and the non-insertion type high-frequency tuners 16 are arranged at the new type high-frequency acceleration cavity, it is possible to provide unexpectedly and extremely high combined effects on high-frequency electric field strength, a Q-factor, dark current, a quantum effect, a charge amount of an electron beam, and average current.

In the abovementioned embodiment, description is performed mainly on the photocathode high-frequency electron-gun cavity apparatus being a 1.5 cell type (with one half cell and one full cell). Naturally, the present invention is applicable to a photocathode high-frequency electron-gun cavity apparatus with the different number of full cells such as a photocathode high-frequency electron-gun cavity apparatus being a 3.5 cell type (with one half cell and three full cells).

INDUSTRIAL APPLICABILITY

The photocathode high-frequency electron-gun cavity apparatus of the present invention is extremely effective for downsizing of a variety of accelerators for generating a high-luminance electron beam, an electron gun, an X-ray generating apparatus with laser inverse Compton scattering, and the like, while enabling to generate a high-strength and high-quality electron beam on the order of ten kilo watts using the ultra-small high-frequency acceleration cavity. In particular, a high-strength and high-quality electron beam on the order of ten kilo watts capable of being generated by the cavity apparatus of the present invention having kinetic energy of accelerated electrons in a range of 6 MeV to 12 MeV is effective for developing a new light-using field such as epochal diagnostic treatment, sterilization, electron beam diffraction, analysis, and photoreaction. Thus, the present invention has industrial applicability.

EXPLANATION OF REFERENCES

1: High-frequency acceleration cavity
2: End part of high-frequency acceleration cavity

3: Side part of high-frequency acceleration cavity
4: Electron beam extraction port
5: Half cell
6: Full cell
7: Photocathode
8: Photocathode face
9: Laser entering port
10: High-frequency power input coupler port
11: Vacuum exhaust port
12: High-frequency resonant tuner
14: Photocathode plug
15: Photocathode plug with RF contactor
16: Non-insertion type high-frequency resonant tuner
17: Solenoid
18: Polarized magnet
22: Housing
22*a*: Circumferential wall portion of housing
24: View port for observing inside of cavity from outside
26: Guide member

The invention claimed is:

1. A photocathode high-frequency electron-gun cavity apparatus structured with a BNL high-frequency acceleration cavity, comprising:

a high-frequency acceleration cavity including a plurality of cavity cells and at least one iris extending between the plurality of cavity cells to connect the plurality of cavity cells, each of the plurality of cavity cells having a curved surface shape formed with any of a trigonometric-function curved line, an arc, an oval, and a parabola on an inner face thereof such that the inner face of the each of the plurality of cavity cells has a smooth and curved surface shape approaching to a standing wave waveform suitable for an acceleration high-frequency high-electric field;

a photocathode which is arranged at an end part of the high-frequency acceleration cavity;

a laser entering port which is arranged at a position facing the photocathode behind an electron beam extraction port of the high-frequency acceleration cavity arranged at another end part and from which laser light is entered into the high-frequency acceleration cavity to be supplied to the photocathode;

a high-frequency power input coupler port which is arranged at a side surface part of the high-frequency acceleration cavity and from which high-frequency power is input into the high-frequency acceleration cavity;

a vacuum exhaust port which is arranged at the side surface part of the high-frequency acceleration cavity and from which the high-frequency acceleration cavity is vacuum-exhausted; and a high-frequency resonant tuner which is arranged at a side of the high-frequency acceleration cavity and which adjusts a high-frequency resonance frequency at the plurality of cavity cells, wherein the inner face of the each of the plurality of cavity cells is formed only with the curved surface shape without having a sharp angle part, each curved surface shape at a vicinity of a top section of the each of the plurality of cavity cells and the at least one iris are formed with arcs, respectively, and each curvature radius R thereof is in a range between 5 and 20 mm inclusive, surface roughness of the inner face of the each of the plurality of cavity cells is 0.05 μm or less, and wherein the photocathode is a photocathode plug having a conductive RF contactor at a section in contact with the high-frequency acceleration cavity and having a $Cs_2Te$ cathode face, and the high-frequency resonant tuner is a non-insertion high-frequency resonant tuner which is arranged at the side of the high-frequency acceleration cavity to mechanically adjust the resonance frequency at the plurality of cavity cells from outside of the high-frequency acceleration cavity without inserting a frequency adjusting rod into the plurality of cavity cells.

2. The photocathode high-frequency electron-gun cavity apparatus according to claim 1, wherein the plurality of cavity cells includes a half cell arranged adjacent to the photocathode plug, and a full cell connected to the half cell through one iris extending between the half cell and the full cell; and the high-frequency power input coupler port is arranged at one side of the side surface part in the full cell, the vacuum exhaust port is arranged at another side of the side surface part facing the one side in the full cell, and the non-insertion high-frequency resonant tuner is arranged at the side of the half cell.

3. The photocathode high-frequency electron-gun cavity apparatus according to claim 2, further comprising a solenoid arranged adjacent to the electron beam extraction port, and a polarized magnet arranged between the solenoid and the laser entering port, wherein the solenoid suppresses increase of emittance of an electron beam from the laser entering port, and the polarized magnet attaches the laser entering port to a position facing the photocathode plug.

* * * * *